US006173542B1

(12) United States Patent
Wright

(10) Patent No.: US 6,173,542 B1
(45) Date of Patent: Jan. 16, 2001

(54) SNAP-ON WOOD TRIM MOLDING

(76) Inventor: Roger Wright, P.O. Box 68, Willmar, MN (US) 56201

( * ) Notice: Under 35 U.S.C. 154(b), the term of this patent shall be extended for 0 days.

(21) Appl. No.: 09/281,193

(22) Filed: Mar. 30, 1999

(51) Int. Cl.[7] ..... E06B 1/60

(52) U.S. Cl. ..... 52/211; 52/212; 52/360; 52/361; 52/716.7; 52/204.53; 24/295

(58) Field of Search ..... 52/211, 210, 212, 52/361, 360, 718.02, 718.03, 716.5, 716.6, 716.7, 782.23, 782.24, 511, 204.53; 24/295, 293, 294

(56) References Cited

U.S. PATENT DOCUMENTS

| | | | | |
|---|---|---|---|---|
| D. 175,229 | | 7/1955 | Neufeld . | |
| D. 378,422 | | 3/1997 | Howe . | |
| D. 388,884 | | 1/1998 | Karnoski . | |
| 1,760,265 | * | 5/1930 | Carr | 52/511 |
| 1,804,831 | * | 5/1931 | Hardesty | 52/716.7 |
| 1,940,933 | * | 12/1933 | Balduf | 52/359 |
| 1,968,168 | * | 7/1934 | Place | 52/511 |
| 2,069,289 | | 2/1937 | Swendsen . | |
| 2,118,800 | * | 5/1938 | Smith | 52/716.7 |
| 2,248,224 | * | 7/1941 | Fernberg | 24/213 |
| 3,746,378 | * | 7/1973 | Meyer | 52/718.03 X |
| 3,956,861 | | 5/1976 | Rasmussen . | |
| 4,076,439 | | 2/1978 | Sakashita . | |
| 4,284,464 | | 8/1981 | Forster . | |
| 4,852,318 | | 8/1989 | Anderson . | |
| 4,946,727 | * | 8/1990 | Kessler | 52/718.02 X |
| 5,222,343 | * | 6/1993 | Anderson | 52/211 X |
| 5,283,096 | * | 2/1994 | Greenberg et al. | 52/716.6 X |
| 5,485,705 | | 1/1996 | Guillemet . | |
| 5,625,992 | | 5/1997 | Strick . | |
| 5,941,046 | * | 8/1999 | Prather | 52/211 X |

* cited by examiner

*Primary Examiner*—Carl D. Friedman
*Assistant Examiner*—Phi Dieu Tran A
(74) *Attorney, Agent, or Firm*—John D. Gugliotta

(57) ABSTRACT

Disclosed is an otherwise conventional wood molding that has a keyhole slot milled along its length on the mounting side thereof. Special mounting plates are attached to the wall via nails or other fasteners and include a specially designed key protrusion that mate with the keyhole slot. Inserting the key into the keyhole slot, the molding can be attached to and removed from the wall quickly, easily and repetitively without damaging either the molding or the wall.

4 Claims, 4 Drawing Sheets

SNAP-ON WOOD TRIM MOLDING

BACKGROUND OF THE INVENTION

1. Field of the Invention

The present invention relates generally to molding trim for doors, windows and the like, and more specifically to molding trim that attaches to a wall or other surface in a removable, snap-on manner.

2. Description of the Related Art

For those of us who have attempted to perform some home remodeling without professional assistance, the phrase "he makes it look easy" takes on a whole new meaning. Carpenters, electricians, plumbers and the like are all skilled tradesmen who spend years honing their skills to a point where professional-quality results are produced routinely in a short amount of time. However, when attempting these functions on their own, do-it-yourselfers can turn seemingly simple projects into monumental tasks which can lead to a waste of time and money as well as a great deal of frustration. A prime example of this phenomenon involves interior painting where one attempts to paint around the various window and door moldings used to trim their respective openings. In doing so, the painter often gets paint on the wood molding material, forcing them to clean the molding. Others choose to use the painstaking method of masking the trim prior to painting. Regardless, the painter spends a great deal of time navigating his or her paintbrush around the trim pieces throughout the room. Accordingly, there is a need for a means through which persons of average skill can paint a room easily, producing attractive and quality results without spending a great deal of time navigating around window and door molding. The development of the present invention fulfills this need.

A search of the prior art did not disclose any patents that read directly on the claims of the instant invention. However, several references trim molding and other molding type devices were discovered. These devices neither anticipate nor disclose any embodiment that would preclude the novelty and the utilitarian functionality of the features of the present invention.

The following patents describe a J-trim corner piece for holding a screen frame, or the like.

U.S. Pat. No. 5,625,992, issued in the name of Strick et al.; and

U.S. Pat. No. 5,485,705, issued in the name of Guillemet.

The following patents describe a corner piece for a miter joint/molding trim.

U.S. Pat. No. 4,852,318 issued in the name of Anderson;

U.S. Pat. No. 4,076,439 issued in the name of Sakashita;

U.S. Pat. No. 2,069,289 issued in the name of Swendsen et al.;

U.S. Pat. No. Des. 388,884 issued in the name of Karnoski;

U.S. Pat. No. Des. 378,422 issued in the name of Howe; and

U.S. Pat. No. Des. 175,229 issued in the name of Neufeld.

U.S. Pat. No. 4,284,464, issued in the name of Forster, discloses an apparatus for making corner joints for molding trim for windows, doors, etc.

U.S. Pat. No. 3,956,861, issued in the name of Rasmussen, describes a trim arrangement with separate slip-fit corner pieces.

While several features exhibited within these references may be incorporated into this invention, alone and in combination with other elements, the present invention is sufficiently different so as to make it distinguishable over the prior art.

SUMMARY OF THE INVENTION

Conventional trim molding is nailed directly to the supporting wall surface. As a result, removing the molding is difficult, if not impossible without causing some damage to either the molding itself or the wall. The present invention consists of otherwise conventional wood molding that has a keyhole slot milled along its length on the mounding side thereof. Special mounting plates are attached to the wall via nails or other fasteners and include a specially designed key protrusion that mate with the keyhole slot. Inserting the key into the keyhole slot, the molding can be attached to and removed from the wall quickly, easily and repetitively without damaging either the molding or the wall. Thus, one can remove the molding in order to paint the walls quickly and easily, without having to navigate door and window trim. As a result, use of the present invention allows those with average painting skills to achieve professional-quality results.

It is therefore an object of the present invention to provide snap-on wood trim molding that removably attaches to a supporting wall surface, allowing for removal during wall painting, washing or other routine maintenance functions.

It is another object of the present invention to provide snap-on wood trim molding in which an anchoring device attaches to a wall or other support surface in a strong and secure manner, allowing for the removable attachment of individual lengths of trim molding strips thereto.

It is another object of the present invention to provide snap-on wood trim molding that has an attractive, wood-like appearance resembling that of traditional trim moldings.

It is another object of the present invention to provide snap-on wood trim molding that is constructed of a material that will accept paint and/or stains in order to alter or adjust its appearance.

It is another object of the present invention to provide snap-on wood trim molding in which a variety of designs and styles are available to match those of conventional wood trim moldings.

It is another object of the present invention to provide snap-on wood trim molding that is attached and removed easily from the supporting wall surface.

It is another object of the present invention to provide snap-on wood trim molding in which a close tolerance fit between the molding and supporting wall surface is formed.

Finally, it is an object of the present invention to provide snap-on wood trim molding that may be constructed of materials including wood, pressed wood, plastic, fiberglass, or other like synthetic material.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

20 Room
21 Snap-On Molding
22 Door
23 Window
24 Base Board
25 Miter Joints
26 Wall
30 Outer Surface
31 Back Surface
35 Support KeyWay
36 Insertion Aperture
37 Clip Receiving Cavity
38 Anchor Recess
40 Anchoring Plate
41 Base
42 Locking Clips
43 Nail Holes
44 Insertion Corner
45 Support Corners
46 Insertion Surfaces
47 Support Surfaces
50 Nails

DESCRIPTION OF THE PREFERRED EMBODIMENTS

1. Detailed Description of the Figures

Figure 1:
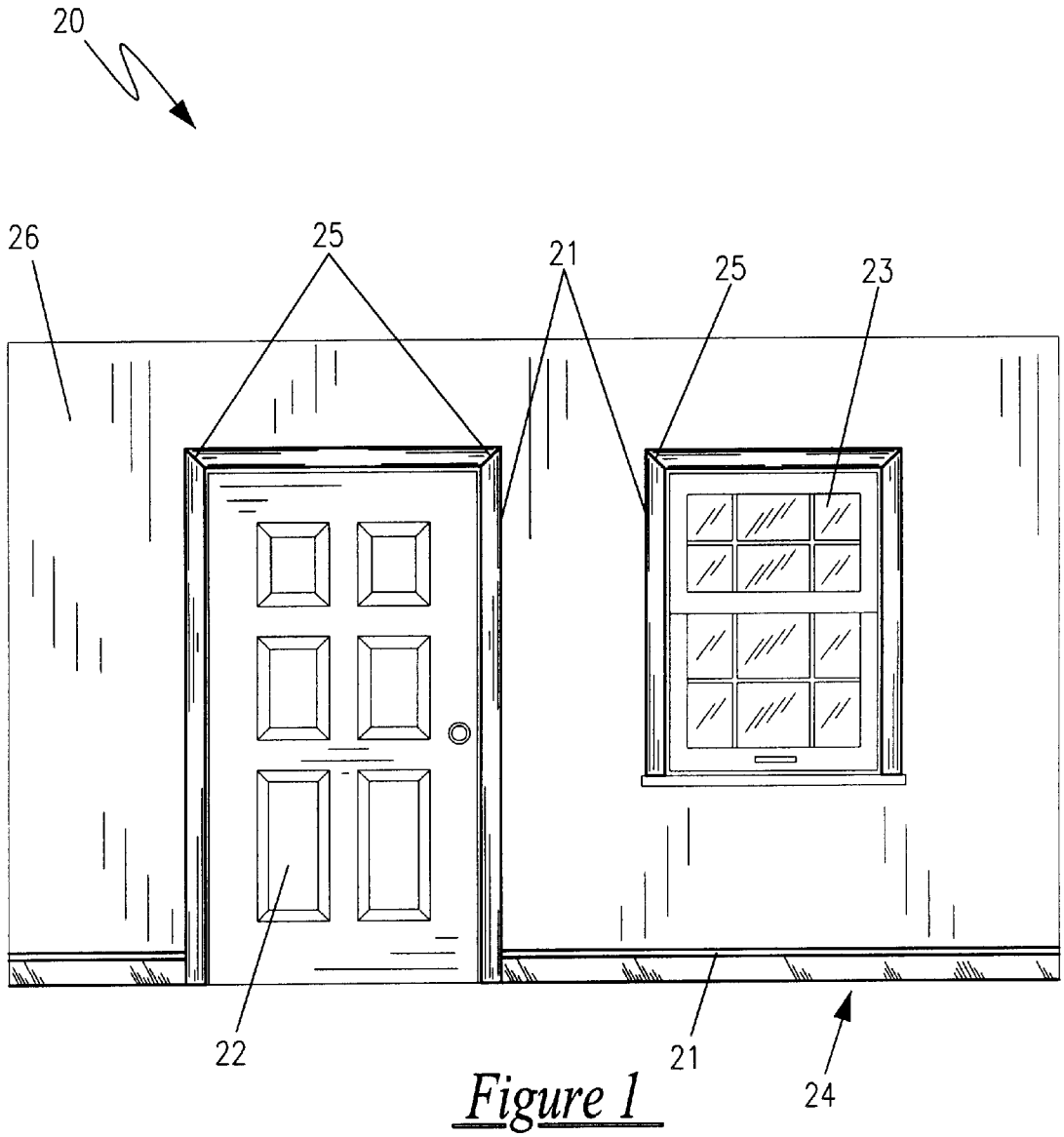
FIG. 1 is an plan view of a room depicting the installation of the snap-on wood trim molding, according to the preferred embodiment of the present invention.
Figure 2:
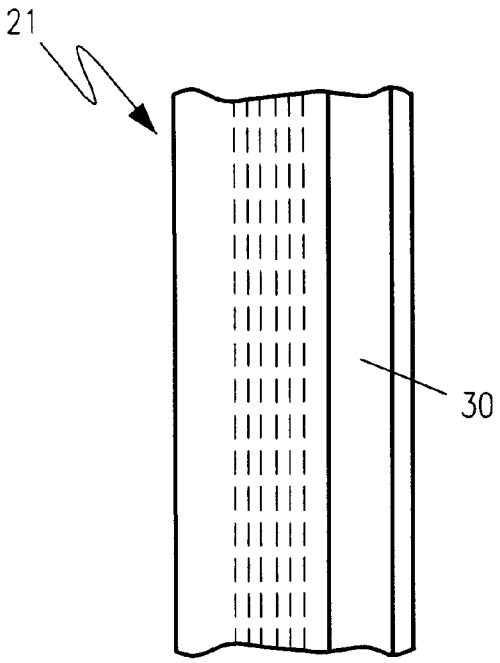
FIG. 2 is a front view of the snap-on wood trim molding, according to the preferred embodiment of the present invention.
Figure 3:
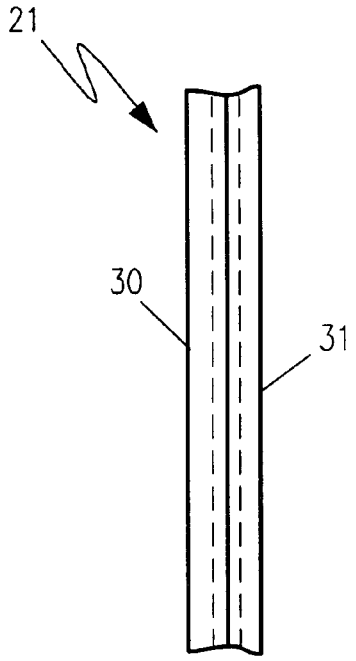
FIG. 3 is a side elevation view of the snap-on wood trim molding, according to the preferred embodiment of the present invention.
Figure 4:
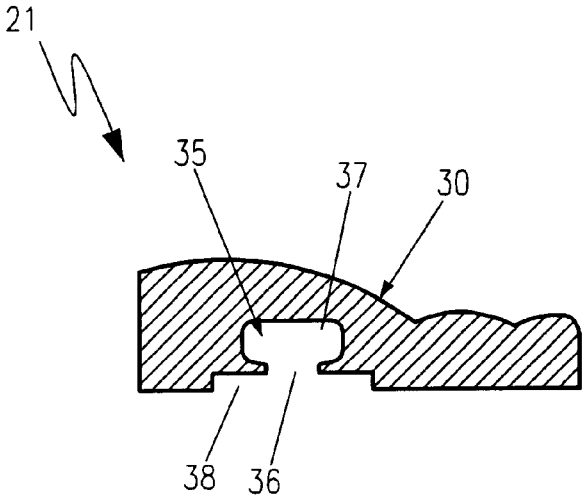
FIG. 4 is a end sectional view of the snap-on wood trim molding, according to the preferred embodiment of the present invention.
Figure 5:
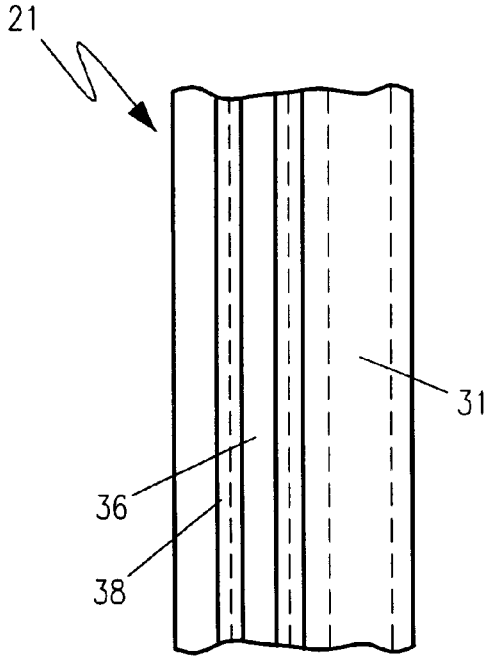
FIG. 5 is a rear view of the snap-on wood trim molding, according to the preferred embodiment of the present invention.
Figure 6:
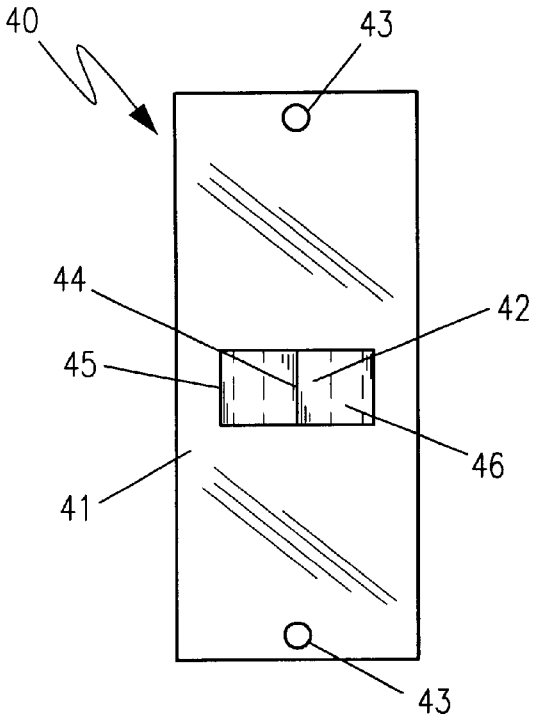
FIG. 6 is a front view of the anchoring plate for use in conjunction with the snap-on wood trim molding, according to the preferred embodiment of the present invention.
Figure 7:
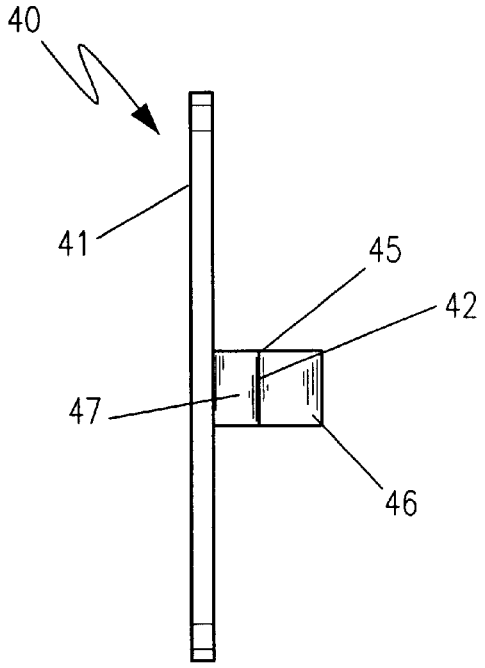
FIG. 7 is a side elevation view of the anchoring plate for use in conjunction with the snap-on wood trim molding, according to the preferred embodiment of the present invention.
Figure 8:
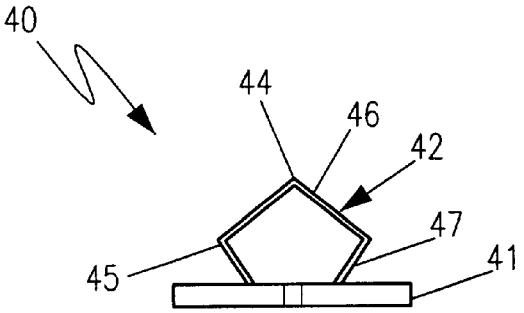
FIG. 8 is a end elevation view of the anchoring plate for use in conjunction with the snap-on wood trim molding, according to the preferred embodiment of the present invention.
Figure 9:
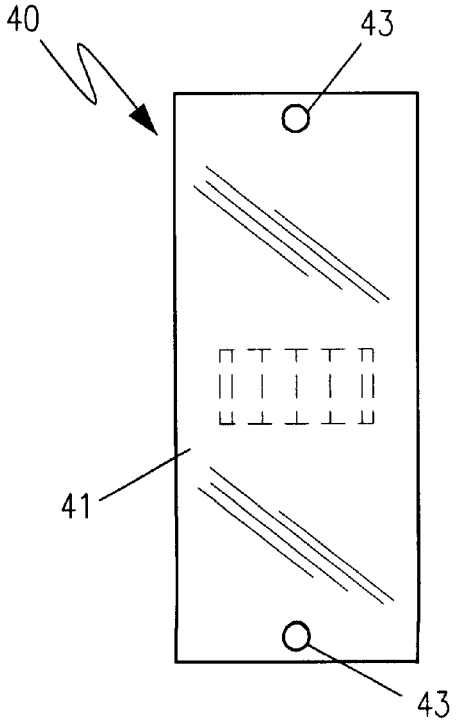
FIG. 9 is a rear view of the anchoring plate for use in conjunction with the snap-on wood trim molding, according to the preferred embodiment of the present invention.

Referring now to FIG. 1, depicted is a typical room 20 wherein the use of the snap-on wood trim molding, hereinafter snap-on molding 21, is shown trimming a door 22, a window 23 and a base board 24. The snap-on molding 21 has a variety of additional uses such as chair molding, crown molding and other similar conventional molding types. The installation and function of the snap-on molding 21, however, is the same regardless of the particular type of molding being used. In these applications, the snap-on molding 21 is cut to length, forming miter joints 25 that allow the entire perimeter to be trimmed, fastening each piece of snap-on molding to the wall 26 or other support surface.

Referring now to FIGS. 2–5, depicted is the snap-on molding 21 according to the preferred embodiment of the present invention. As depicted most clearly in FIG. 4, the shape or contour of the snap-on molding 21 is that of conventional window or door casing type moldings. It should be noted that there are literally hundreds of different styles and types of molding available on the market today, most, if not all of which can be incorporated into the design of the snap-on molding 21. The particular type chosen for the Figures is merely a representative sample chosen to illustrate the function of the present invention. Furthermore, the material construction of the snap-on molding 21 can vary widely, incorporating materials such as wood, pressed wood, particle board, plastic, fiberglass and a variety of other like synthetic materials. Regardless of the material construction, however, the function of the snap-on molding 21 is identical.

The snap-on molding 21 has a contoured, decorative outer surface 30 and a flat back surface 31 that mates against the wall or other support surface upon which the snap-on molding is secured. A support key way 35 is milled or otherwise formed along the entire length of the snap-on molding 21. Viewed best in FIG. 4, the support key way 35 consists of a insertion aperture 36 that leads to an enlarged clip receiving cavity 37. The support key way 35 itself is recessed from the back surface 31 in an anchor recess 38.

Referring now to FIGS. 6–9, depicted is an anchoring plate 40 that is used to support the snap-on molding 21 from a wall 26 or other similar support structure. The anchoring plate 40 consists of a base 41 used to support at least one spring biased locking clips 42. A pair of nail holes 43 are bored through the base 41, allowing the anchoring plate 40 to be fastened to the wall 26 using nails 50 or other like fasteners.

In the Figures, the use of three locking clips 42 are depicted on the anchoring plate 40, although it is realized that any number locking clips 42 would be sufficient. The locking clips 42 are generally square or rectangular in shape and are rotated approximately 45 degrees with respect to the surface of the base 41, attached thereto such that an insertion corner 44 of the rectangular shape lies opposite the point of attachment to the base 41, in between a pair of support corners 45. The length of material between the insertion corner 44 and the support corners 45 define a pair of insertion surfaces 46. The length of material between the support corners 45 and the base 41 define a pair of support surfaces 47. The material used in the construction of the locking clips 42 must be such that they distort under a compression force, yet return to the original shape when the compression force is removed. Realizing that hardness and thickness are the main factors that will determine the flexibility and resilience of the locking clips 42, there are a variety of combinations that will produce the desired result.

The locking clips 42 are designed to be inserted into the support key way 35, fastening the snap-on molding 21 to the wall 26 adjacent to the window 23 or door 22 being trimmed. Inserting the insertion corner 44 through the insertion aperture 36 and into the clip receiving cavity 37, an interference is created between the locking clips 42 and the support key way 35. As the snap-on molding 21 is pressed onto the anchoring plate 40, the interference between the insertion aperture 36 and the locking clips 42 creates a compression force that acts perpendicularly to the back surface 31 of the snap-on molding 21. The angled orientation of the insertion surfaces 46 with respect to the direction of the compression force causes the force to be broken into component forces that compress the locking clip 42 such that the support corners 45 are drawn together, allowing the locking clip 42 to enter the clip receiving cavity 37 of the support key way 35. Once the locking clip 42 has entered the support key way 35, the interference fit is relieved, allowing the locking clip 42 to expand to its original form under the resiliency of its material construction. Expanded within the clip receiving cavity 37, the support surfaces 47 create an interference fit with the insertion aperture 36 that retains the locking clip within the support key way 35. Designed to have close to zero tolerance between the internal dimensions of the clip receiving cavity 37 and the outside dimensions of the locking clip 42, the attachment of the snap-on molding 21 to the anchoring plate 40 is tight and secure, rather than loose, and is not prone to shake or rattle.

Removing the anchoring plate 40 from the support key way 35, an interference is again created between the locking clips 42 and the support key way 35. As the snap-on molding 21 is pulled from the anchoring plate 40, the interference between the insertion aperture 36 and the locking clips 42 creates a compression force that acts out from the support key way 35, perpendicularly to the back surface 31 of the snap-on molding 21. The angled orientation of the support surfaces 47 with respect to the direction of the compression force causes the force to be broken into component forces that compress the locking clip 42 such that the support corners 45 are drawn together, allowing the locking clip 42 to leave the clip receiving cavity 37 of the support key way 35, thus separating the anchoring plate 40 from the snap-on molding 21.

2. Operation of the Preferred Embodiment

Figure 10:
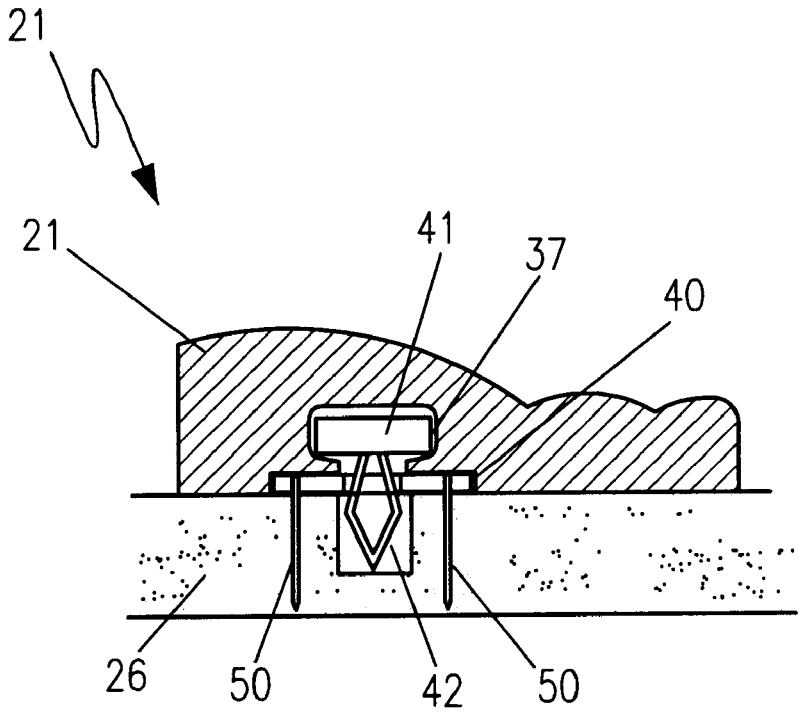
FIG. 10 is a end sectional view depicting the use of the anchoring plate to support the snap-on wood trim molding from a wall or other like support surface, according to the preferred embodiment of the present invention.

In accordance with the preferred embodiment of the present invention and as shown in FIG. 10, the snap-on molding 21 is used to provide removable trim that allows for easy painting, cleaning or maintenance. The anchoring plate 40 is fastened to a wall 26 using nails 50 that are passed through the nail holes 43. As each individual style or design of the snap-on molding 21 will be milled such that the support key way 35 lies in the same position with respect to the edges, the anchoring plates 40 can be properly positioned quickly and easily using a variety of conventional template methods. Once the anchoring plate 40 is secured to the wall 26, the snap-on molding 21 can be pressed into place, inserting the locking clips 42 into the support key way 35. Removal of the snap-on molding 21 is achieved by simply prying or otherwise pulling in order to separate it from the anchoring plates 40.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. A snap-on wood trim molding for use in architecturally trimming a door, a window, or a base board, said molding comprising:

outer molding surface element, said element having a decorative outer surface and a flat back surface, said flat back surface being capable of mating flat against a wall or other support surface upon which the snap-on wood trim molding is secured;

a support key way, said support key way formed along the entire length of the snap-on molding and recessed into said flat back surface and forming an anchor recess;

an anchoring plate, said anchoring plate having a base to support at least one spring biased locking clips and forming a pair of nail holes penetrating through said base, thereby allowing said anchoring plate to be fastened to a wall using conventional nails or screw fasteners; and at least one locking clips, said locking clips each being generally square or rectangular in shape and capable of being rotated approximately 45 degrees with respect to the surface of the base;

and wherein said locking clips can be attached to said anchor plate thereto such that said locking clip can physically impinge within said anchor recess.

2. The molding of claim 1, wherein said outer molding surface element is selected from the grouping comprising chair molding, crown molding, colonial molding, and other similar conventional molding types.

3. The molding of claim 1, wherein said support key way forms an insertion aperture that leads to an enlarged clip receiving cavity.

4. The molding of claim 1, wherein said locking clips are formed such that they distort under a compression force, yet return to the original shape when the compression force is removed.

* * * * *